US006508578B2

(12) United States Patent
Yoda et al.

(10) Patent No.: US 6,508,578 B2
(45) Date of Patent: Jan. 21, 2003

(54) INDICATION LAMP

(75) Inventors: Takashi Yoda, Shizuoka (JP); Kunio Toyota, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/876,804

(22) Filed: Jun. 7, 2001

(65) Prior Publication Data

US 2001/0053071 A1 Dec. 20, 2001

(30) Foreign Application Priority Data

Jun. 8, 2000 (JP) ..... 2000-172645

(51) Int. Cl.[7] ..... F21S 10/02

(52) U.S. Cl. ..... 362/545; 362/800; 362/812; 340/815.45; 40/573

(58) Field of Search ..... 362/23, 29, 470, 362/471, 800, 812, 240, 310, 367, 545, 276, 802; 340/815.45, 815.65; 40/573

(56) References Cited

U.S. PATENT DOCUMENTS 4,754,202 A * 6/1988 Havel ..... 313/500
5,604,480 A * 2/1997 Lamparter ..... 340/433

FOREIGN PATENT DOCUMENTS

JP 401037692 A * 2/1989
JP 411163418 A * 6/1999

* cited by examiner

*Primary Examiner*—Sandra O'Shea
*Assistant Examiner*—Hargobind S. Sawhney
(74) *Attorney, Agent, or Firm*—Koda & Androlia

(57) ABSTRACT

An indication lamp for, for instance, aircraft passenger cabins comprising light sources housed in lamp chambers defined by a housing and a front cover. Translucent indication portions of the shapes indicative of non-smoking and fasten-seatbelt signs in red, for instance, are formed in the front cover; and the light sources, each comprising a set of light emitting diodes of different colors, such as green and red, are installed behind the translucent indication portions so that each light source emits a mixture of colors that is similar to an incandescent light, thus illuminating the sings with an enhanced visibility.

6 Claims, 7 Drawing Sheets

INDICATION LAMP

BACKGROUND OF THE INVENTION

1. Field of the Invention

The present invention relates to an indication lamp and more particularly to an indication lamp having a translucent indication portion and used in aircraft passenger cabins.

2. Prior Art

Indication lamps are used in a passenger cabin of an aircraft so as to prompt passengers to, for instance, refrain from smoking and to fasten their seat belts. An incandescent lamp has conventionally been used as a light source for such passenger cabin indication lamps.

FIG. 7 shows a typical indication lamp of this kind.

The indication lamp is constructed by a plurality of incandescent lamps 110A and 110B mounted on printed wiring boards 108A and 108B, respectively, housed in two lamp chambers 106A and 106B formed by a housing 102 and a front cover 104. Translucent indication portions 112A and 112B that allow part of the light from the incandescent lamps 110A and 110B to pass through are formed on the front cover 104 so as to be in front of the lamp chambers 112A and 112B. When the incandescent lamps 110A in the lamp chamber 106A are lit, the incandescent lamps 110A illuminate the translucent indication portion 112A from behind to give a non-smoking sign indication. When the incandescent lamps 110B in the lamp chamber 106B are lit, the incandescent lamps 110B illuminate the translucent indication portion 112B from behind to give a seat belt fastening sign indication.

In the above conventional indication lamp that uses an incandescent lamp as a light source thereof, however, a filament thereof tends to be broken due to vibrations and other causes acting on the aircraft. On top of that, the life of the incandescent lamp (approximately 200 hours) is generally extremely short when compared to the useful life of aircraft (approximately 73,000 hours), which makes it necessary to replace the incandescent lamp frequently.

White light emitting diodes can be used instead as the light source of the indication lamp. Such diodes can extend the life of indication lamps greatly (approximately 30,000 hours) compared to the incandescent lamp, making it generally possible to solve the above problem.

However, the white light emitting diode emits a white light of a cool color, not like a soft light of a warm color emitted by incandescent lamps. It gives the passenger who looks at the translucent indication portions 112A and 112B a cold impression, presenting a visibility problem.

If the light source for only a part of a plurality of indication lamps disposed in the passenger cabin is changed to white light emitting diodes, that particular indication lamp lights up in a different color from other indication lamps whose light sources are incandescent lamps, causing an inferior visual impression.

Such problems arise not only from the indication lamps provided in passenger cabins of aircraft, but also from general indication lamps that have translucent indication portions.

SUMMARY OF THE INVENTION

Accordingly, the object of present invention is to provide an indication lamp having a translucent indication portion, in which the life of a light source is significantly extended and, at the same time, a visibility of the translucent indication portion can be enhanced.

The present invention accomplishes the above object by way of using as light sources a plurality of light emitting diodes of different colors of illumination, thus obtaining a color similar to a light emitted by an incandescent lamp with a mixture of colors emitted by such light emitting diodes.

The above object is accomplished by a unique structure of the present invention for an indication lamp that has a light source and a front cover on which a translucent indication portion of a predefined shape that allows a part of light from the light source to pass through is formed; and the unique structure of the present invention is that the light source is formed with a plurality of light emitting diodes that have different colors of illumination, and these light emitting diodes are designed to light up simultaneously so as to illuminate a mixture of colors that is similar to a light emitted by an incandescent lamp.

In the above structure, the indication lamp may be constructed by only a single light source of a plurality light emitting diodes or a plurality of light sources.

Also, in regards to the plurality of light emitting diodes, the color of illumination of each light emitting diode, the number of light emitting diodes used, the disposition of the light emitting diodes, and other specific arrangements are not limited as long as they illuminate, when lit, a mixture of colors similar to the light emitted by the incandescent lamp.

The phrase "different colors of illumination" used in the above means that not all of the light emitting diodes emit the same color. Two or more light emitting diodes that emit the same color of illumination can be employed in the present invention.

Furthermore, the phrase "a mixture of colors similar to a light emitted by an incandescent lamp" more specifically means a color that falls within the regions of $0.37 \leqq x \leqq 0.60$ and $0.34 \leqq y \leqq 0.50$ in the CIE chromaticity diagram.

It is preferable that the color is within the regions of $0.42 \leqq x \leqq 0.57$ and $0.38 \leqq y \leqq 0.46$.

As described above, the indication lamp according to the present invention comprises a plurality of light emitting diodes having different colors of illumination as the light source, and these light emitting diodes light up simultaneously and illuminate a mixture of colors similar to the light emitted by the incandescent lamp.

Accordingly, since the lamp comprises a plurality of light emitting diodes, the life of the light source can be extended greatly compared to the conventional structure that uses incandescent lamps. The extended life of the light source is even further assured because in the present invention a single-color light emitting diode with a life (approximately 100,000 hours) that is even longer than a white light emitting diode is employed, instead of the white light emitting diode, as the light emitting diodes that form the light source. Furthermore, in the indication lamp of the present invention, a plurality of light emitting diodes light up simultaneously so as to illuminate a mixture of colors similar to or the substantially the same as the light emitted by the incandescent lamp. Thus, the translucent indication portion of the front cover is illuminated by a soft light of a warm color which is like a light emitted by incandescent lamps.

Accordingly, with the indication lamp that has the translucent indication portion in the front cover according to the present invention, it is possible to significantly extend the life of the light source and, at the same time, to enhance the visibility of the translucent indication portions.

In cases where a plurality of indication lamps are disposed as in the passenger cabin of an aircraft, and where a part of the light sources for these indication lamps is changed from the conventional incandescent lamps to a plurality of light emitting diodes, such indication lamps can be prevented from being seen in a color significantly different from the color of the remaining indication lamps.

As described above, there is no limitation to a specific configuration of each light emitting diode that forms the plurality of light emitting diodes. It is nonetheless easy to accomplish the illumination of a mixture of colors similar to the color of the incandescent lamp by way of forming the light emitting diodes with red light emitting diodes and green light emitting diodes.

A red translucent indication portion can be formed in part of the translucent indication portion. With this red translucent indication portion, it is possible to illuminate the portions other than the red translucent portion with a color similar to the color of the incandescent lamp and, at the same time, to illuminate the red translucent portion with red that is more vivid than the color emitted by the red light emitting diode when the light sources are lit.

The above-described light sources may be designed so that all the light emitting diodes that form the light sources are lit simultaneously. A light-up mode can be established so that it comprises a simultaneous light-up mode, in which both the red light emitting diodes and the green light emitting diodes are lit at the same time, and a green light-up mode, in which only the green light emitting diodes are lit. This light-up mode design provides significant operational advantages. In the simultaneous light-up mode, the red translucent portion is illuminated in red, while the remaining portions are illuminated with a color similar to the incandescent light. In the green light-up mode, on the other hand, the red translucent portion is not illuminated, while the remaining portions are illuminated in green. Accordingly, viewers or can easily know that there has been a change in the light-up mode of the indication lamp.

DETAILED DESCRIPTION OF THE INVENTION

The embodiments of the present invention will be described below with reference to the accompanying drawings.

Figure 1:
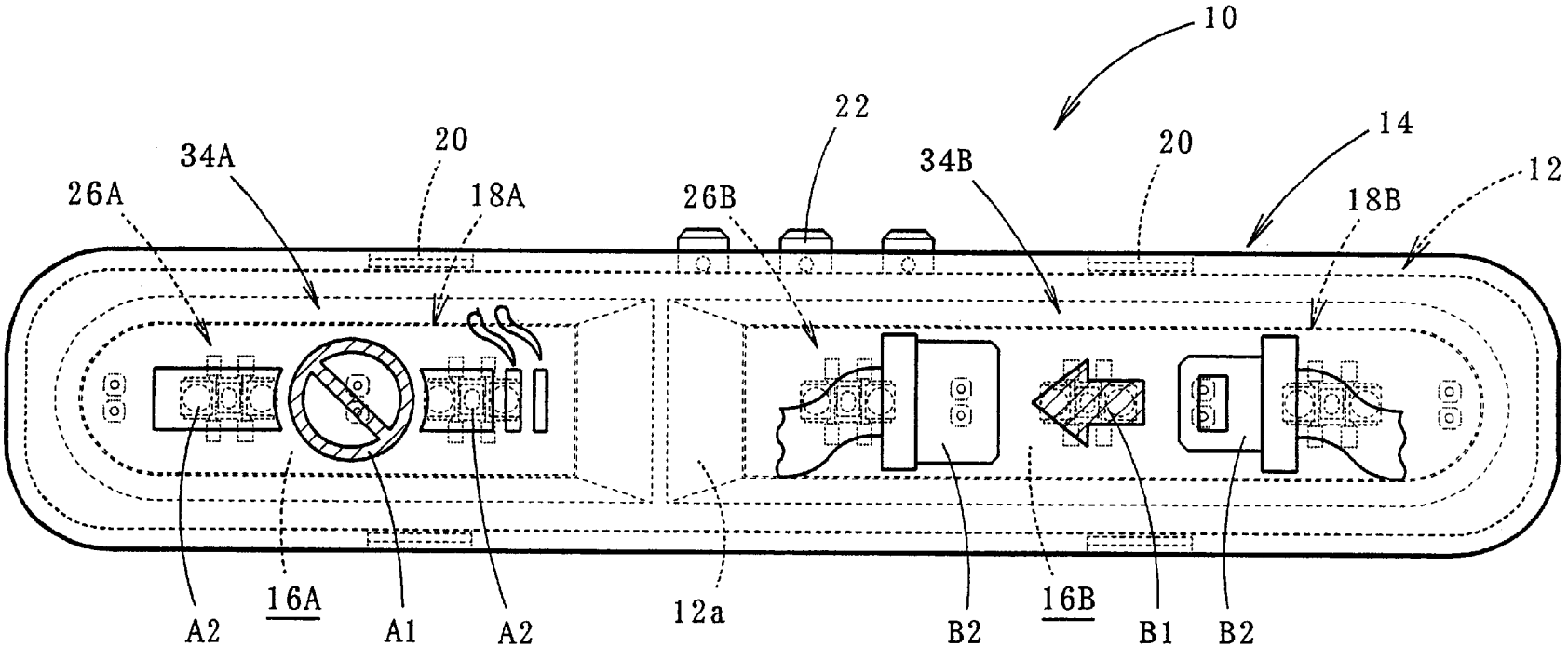
FIG. 1 is a front view of the indication lamp according to one embodiment of present invention.
Figure 2:
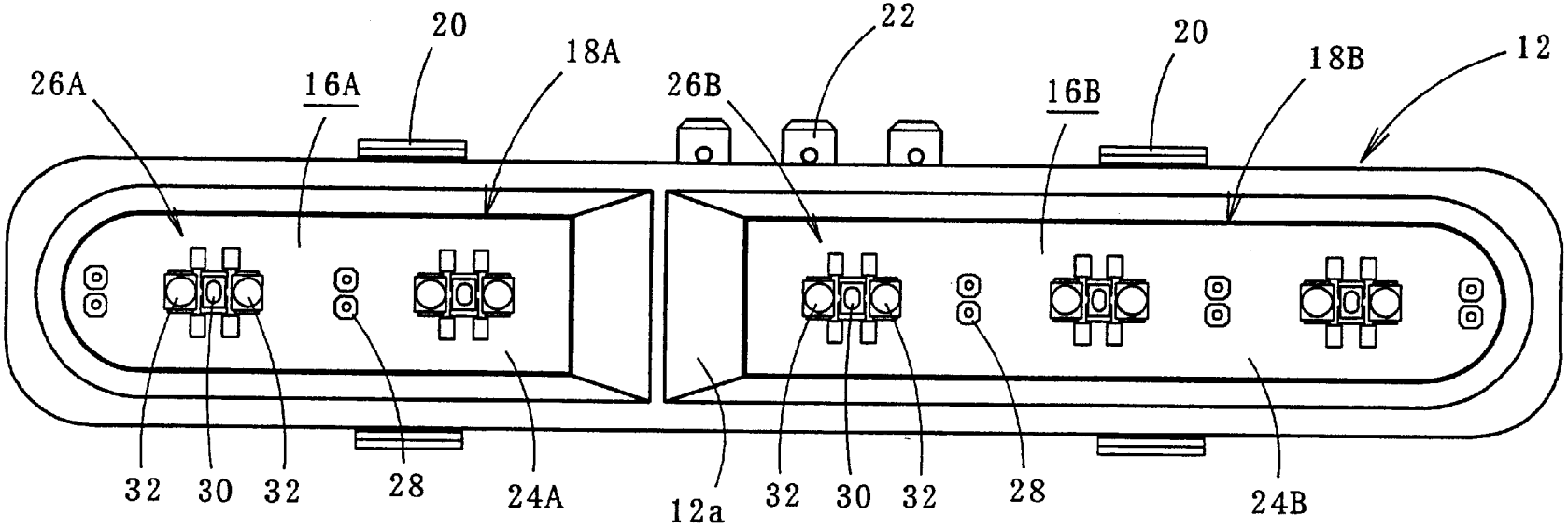
FIG. 2 is a front view thereof with the front cover removed.
Figure 3:
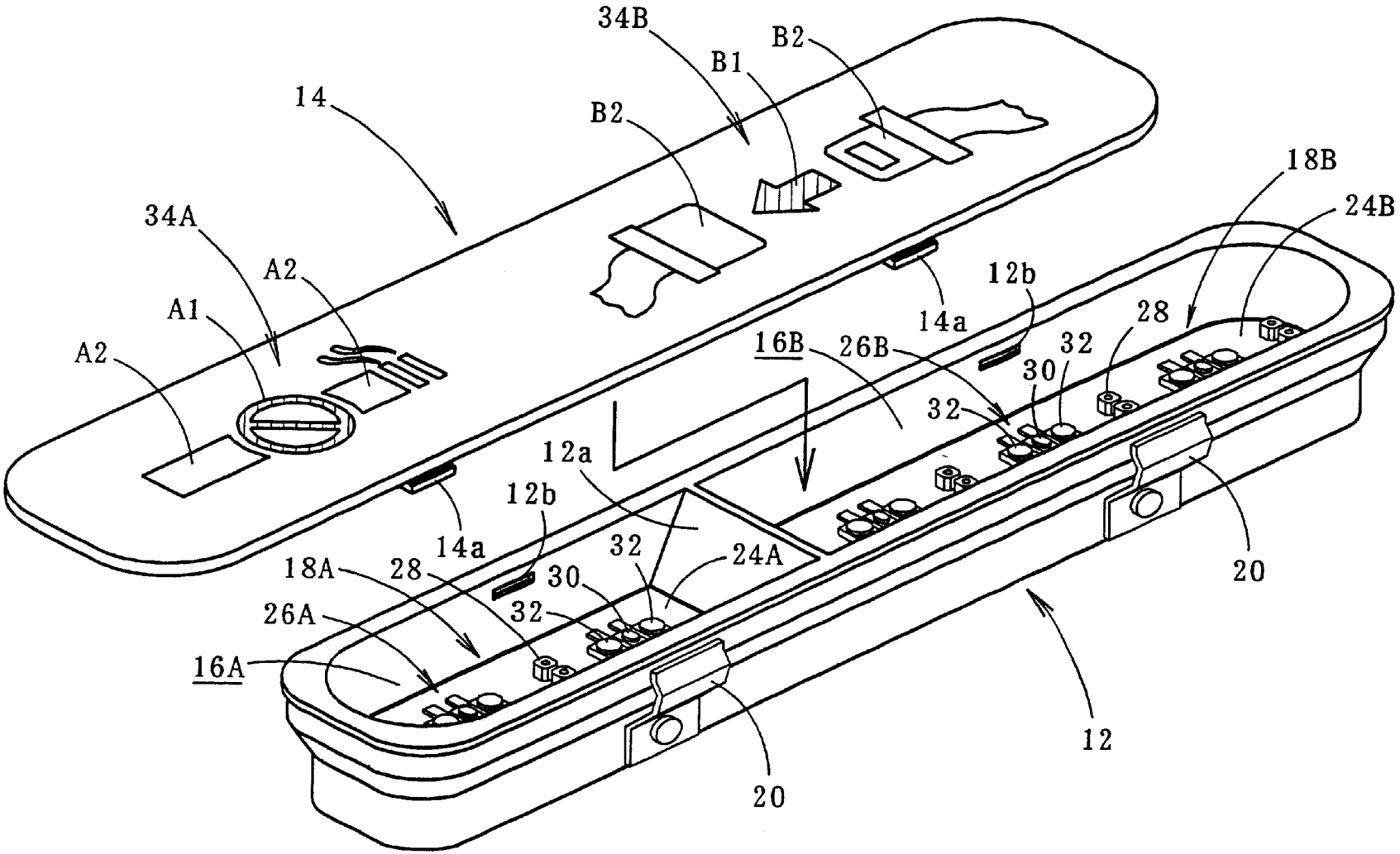
FIG. 3 is an exploded perspective view thereof.

Referring first to FIGS. 1 through 3, an indication lamp 10 is provided in, for instance, a ceiling toward an upper frontal direction of each seat in an aircraft passenger cabin. The overhead indication lamp 10 prompts passengers to refrain from smoking and/or to fasten seat belts.

The indication lamp 10 comprises light source units 18A and 18B housed in two lamp chambers 16A and 16B, respectively, formed by a housing 12 and a front cover 14, the lamp chamber 1A being smaller than the lamp chamber 16B.

The housing 12 is a white polycarbonate resin molding formed into a slender box shape. The housing has a partition wall 12*a* near the center in the longitudinal direction that separates the two lamp chambers 16A and 16B of different sizes. Two sets of cover engagement slits 12*b* are formed in inner surfaces of both sidewalls of the housing 12.

Two sets of cabin attaching springs 20 are fitted to both side face portions of the housing 12, and three lugs 22 are provided side-by-side in a row on one side face portion (on the longer side) of the housing 12. The indication lamp 10 is mounted to the ceiling of the cabin so that the lugs 22 are connected to connectors (not shown) of the cabin ceiling, the housing 12 is inserted into a horizontal opening (now shown) formed in the ceiling, the attaching springs 20 are engaged with the horizontal opening.

The light source unit 18A housed in the smaller lamp chamber 16A comprises a printed wiring board 24A and two light sources 26A mounted on the printed wiring board 24A at predetermined intervals in the longitudinal direction of the printed wiring board 24A. The printed wiring board 24A is attached to the bottom of the housing 12 by screws 28.

Likewise, the light source unit 18B is housed in the larger lamp chamber 16B, and it comprises a printed wiring board 24B and three light sources 26B mounted on the printed wiring board 24B at predetermined intervals in the longitudinal direction of the printed wiring board 24B. The printed wiring board 24B is attached to the bottom of the housing 12 by screws 28.

Each of the light sources 26A and 26B has the same construction, comprising three light emitting diodes disposed adjacent to each other in the longitudinal direction. As best seen from FIG. 2, a light emitting diode 30 at the center of the three is a green light emitting diode that emits a green light. Light emitting diodes 32 on both sides of the green light emitting diode 30 are red light emitting diodes that emit a red light.

The front cover 14 is a colorless and translucent (milky-white) polycarbonate resin molding and has surface coating thereon. The front cover 14 is shaped into a slender rectangle so as to cover the opening of the housing 12 and has two sets of engagement tabs 14a formed on both sides of the back surface. Each of these engagement tabs 14a engages each of the cover engagement slits 12b formed in the housing 12. The front cover 14 is thus installed on the housing 12.

Translucent indication portions 34A and 34B for allowing part of the light from light sources 10A and 10B to pass through are formed in the front cover 14 so as to be in front of the lamp chambers 16A and 16B, respectively. The translucent indication portion 34A is a non-smoking sign, and the translucent indication portion 34B is a fasten seat belt sign.

The translucent indication portions 34A and 34B are formed so that a resist coating is first applied to portions on which the translucent indication portions 34A and 34B are to be formed, black undercoating and white top coating are applied to these surfaces, then the resist coating is removed to form coating-removed portions.

Of the translucent indication portion 34A, a translucent red printing is applied to the backside of the prohibition mark A1 so that it serves as a red translucent portion. The cigarette mark portions A2 are left as coating-removed portions. Furthermore, of the translucent indication portion 34B, a translucent red printing is applied to the backside of the arrow mark B1 so that it serves as a red translucent portion. The seat belt mark portions B2 on both sides of the arrow mark are left as coating-removed portions.

The indication lamp 10 has an ON-OFF control system for each one of the light source units 18A and 18B.

More specifically, for prohibiting smoking, two light sources 26A of the light source unit 18A are lit simultaneously. When it is unnecessary to prohibit smoking, they are both turned OFF simultaneously. When it becomes necessary to have passengers fasten their seat belts, three light sources 26B of the light source unit 18B are lit simultaneously. When it is not necessary to have passengers fasten their seat belts, they are both turned OFF simultaneously.

When each of the light source units 18A and 18B is in the light-up mode, the single green light emitting diode 30 and two red light emitting diodes 32 that form each of the light sources 26A and 26B are all lit. When they are all lit, the color of illumination emitted by the green light emitting diode 30 and the color of illumination emitted by the red light emitting diodes 32 are mixed together, thus rendering each of the light sources 26A and 26B to emit a mixture of colors that is similar to the color of an incandescent lamp.

Figure 4:
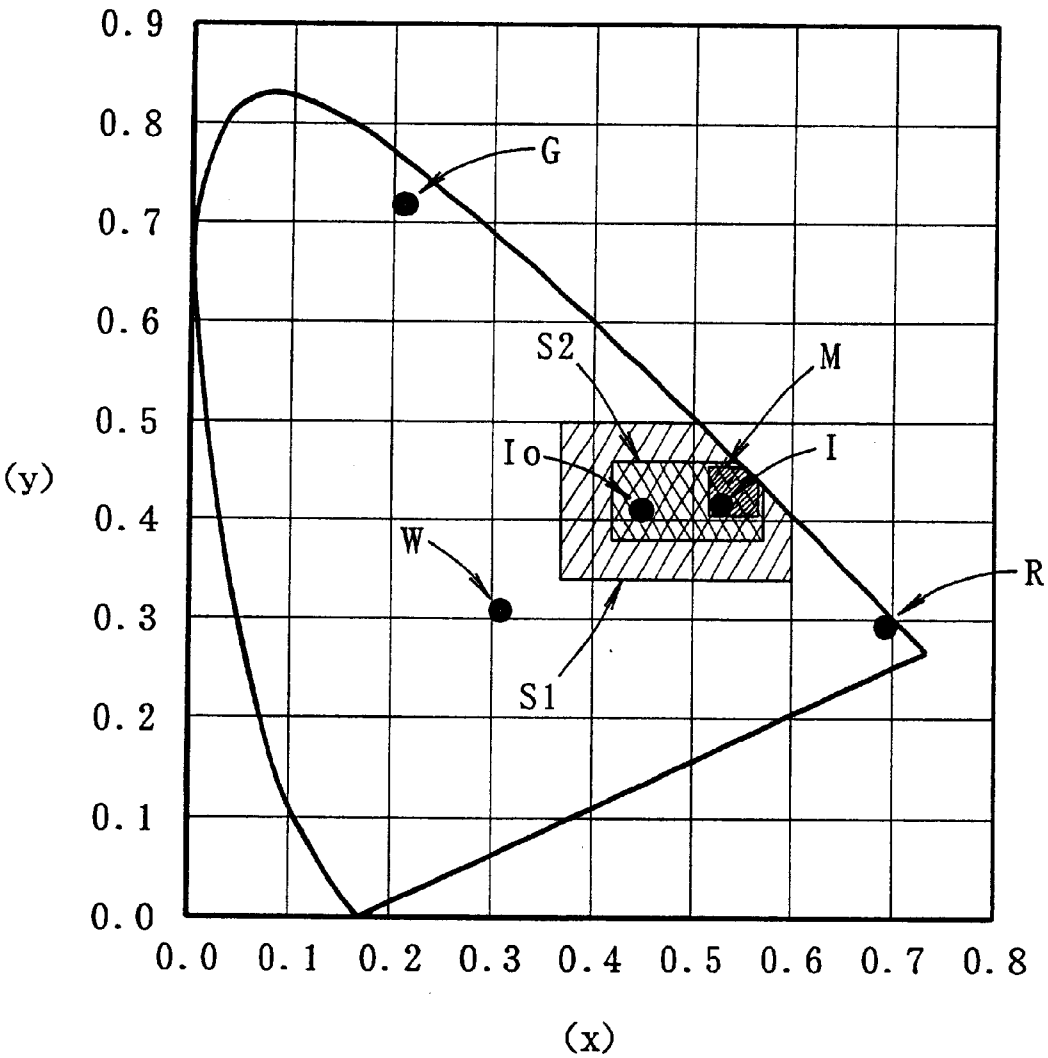
FIG. 4 is a CIE chromaticity diagram showing the operations of the embodiment of the indication lamp of the present invention.

More specifically, in the CIE chromaticity diagram shown in FIG. 4, the incandescent light is at point Io (x=0.45, y=0.41), the light emitted by the green light emitting diode 30 is at point G (x=0.21, y=0.72), and the light emitted by the red light emitting diode 32 is at point R (x=0.69, y=0.29). The light emitted by the mixture of the light that is emitted by the green light emitting diode 30 and two red light emitting diodes 32 is within the mixture region M (x=0.54±0.025, y=0.43±0.025) that is close to the incandescent light Io, giving off a color similar to the incandescent light Io.

FIG. 4 further shows a light emitted by a white light emitting diode and that is at point W (x=0.3 1, y=0.31). In addition, the light emitted by an incandescent lamp used in the conventional indication lamp (an overhead indication lamp for each seat in the passenger cabin of aircraft) is shown at point I (x=0.53, y=0.42) in FIG. 4.

As seen from FIG. 4, the light emitted by the mixture of light, that is emitted by the green light emitting diode 30 and red light emitting diodes 32, is completely different from the light W emitted by the white light emitting diode and is very close to the light I emitted by the incandescent lamp employed in the conventional indication lamp. The reason why the light I emitted by the incandescent lamp employed in the conventional indication lamp differs from the incandescent light Io is because the luminance is set to a lower level so as to extend the life of incandescent lamps.

Figure 5A:
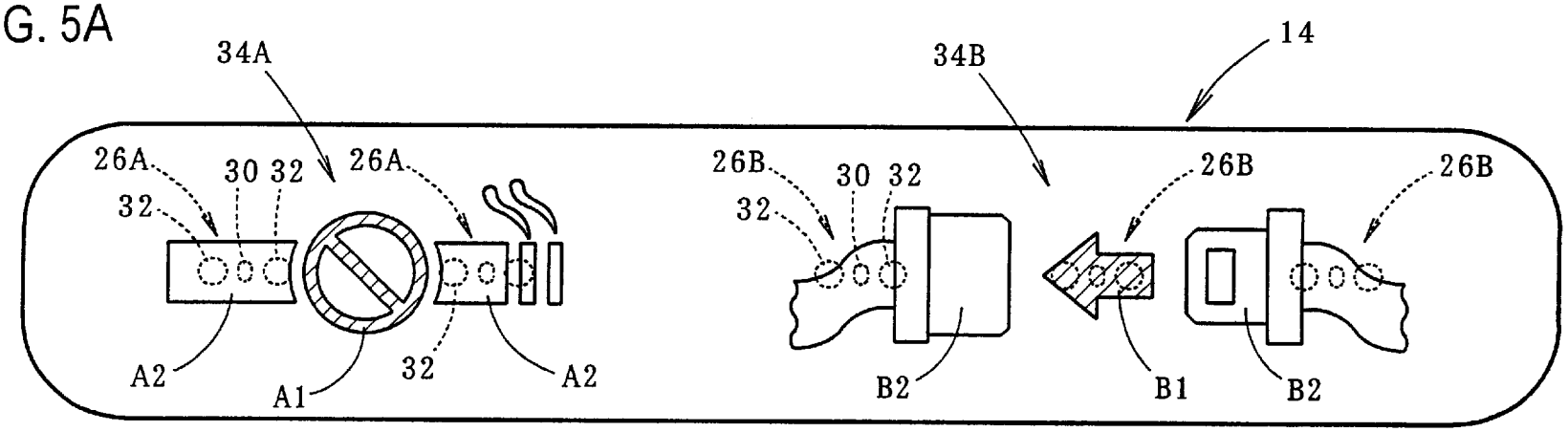
FIGS. 5A and 5B are front views of the front cover showing an operation of the embodiment of the present invention.
Figure 5B:
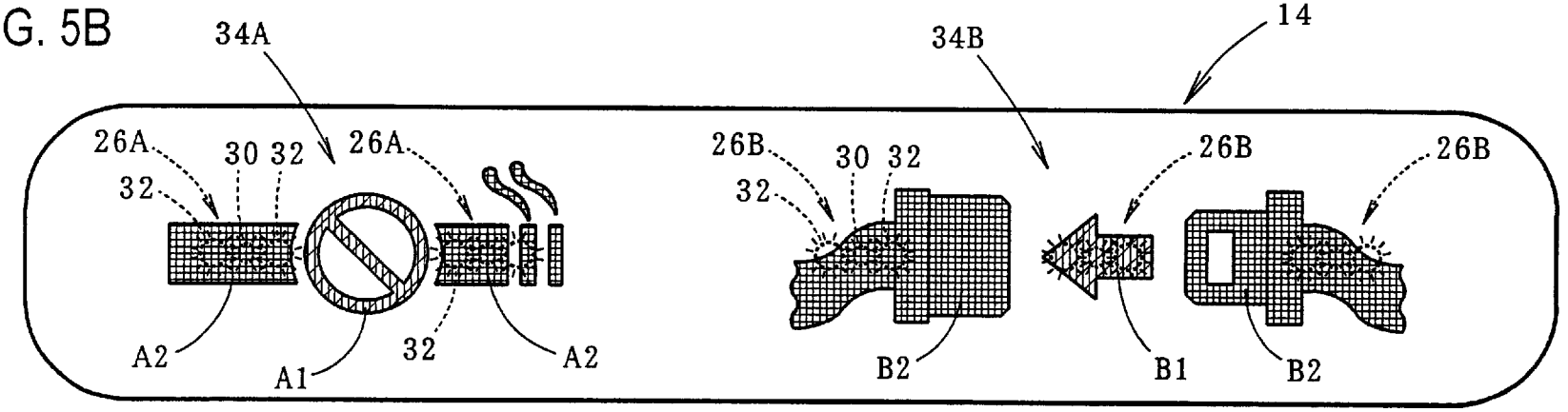

FIG. 5A shows the front cover 14 under an OFF mode, and FIG. 5B shows the front cover 14 under a light-up mode.

When the light source units 18A and 18B are in the OFF mode, only parts of the translucent indication portions 34A and 34B look dimly, as shown in FIG. 5A, in milky-white on the surface of the front cover 14 to which a white top coating is applied. At this time, the prohibition mark A1 of the translucent indication portion 34A and the arrow mark B1 of the translucent indication portion 34B look slightly reddish because of the red printing applied to the backside of the front cover 14. In FIG. 5B, on the other hand, when both light source units 18A and 18B are in the light-up mode, both the green light emitting diode 30 and the red light emitting diodes 32 that form each of the light sources 26A and 26B are lit. Thus, the translucent indication portions 34A and 34B are illuminated with a light similar to the incandescent light from behind, making the cigarette mark portions A2 of the colorless translucent indication portion 34A and the seat belt mark portions B2 of the translucent indication portion 34B look brightly in a color similar to the incandescent light. The prohibition mark A1 of the translucent indication portion 34A and the arrow mark B1 of the translucent indication portion 34B look brightly in vivid red, since the red light from the red light emitting diode 32 illuminates these portions from behind and passes directly through the red printing surfaces.

As described above, in the indication lamp 10 of the shown embodiment, each of the light sources 26A and 26B that form the light source units 18A and 18B comprises a single green light emitting diode 30 and two red light emitting diodes 32, and these three light emitting diodes 30 and 32 are lit simultaneously to emit a mixture of colors that is similar to the incandescent light. Therefore, several operational advantages can be obtained.

Since each of the light sources 26A and 26B comprises the green light emitting diode 30 and the two red light emitting diodes 32, a service life of about 100,000 hours, which is longer than the life of the white light emitting diode of about 30,000 hours and even the useful life of aircraft of about 73,000 hours, not to mention the life of the incandescent lamp of about 200 hours, can be obtained. This allows the indication lamp 10 to be maintenance-free.

In addition, each of the light sources 26A and 26B emits a mixture of colors similar to the incandescent light when the green light emitting diode 30 and the two red light emitting diodes 32 are simultaneously lit. Accordingly, the translucent indication portions 34A and 34B are illuminated by a soft light of a warm color as in incandescent lamps.

Furthermore, when each of the light sources 26A and 26B is in the OFF mode, each of the translucent indication portions 34A and 34B looks milky-white, though dimly. As a result, if each one of the light sources 26A and 26B emitted a white light in the light-up mode, there would be only a small difference in hue from the milky-white color in the OFF mode, and thus it would be extremely difficult to have passengers aware that the mode has changed to the lighting-up (or warning) mode. In the shown embodiment, however, since each of the light sources 26A and 26B emits a mixture of colors similar to the incandescent light, the passengers can easily recognize the mode change.

In addition, in the shown embodiment, a white top coating is applied to the surface of the front cover 14. Thus, if each of the light sources 26A and 26B emitted a white light in the light-up mode, each of the translucent indication portions 34A and 34B would emit a white light, and there would be substantially no difference in hue from surrounding areas. However, since the light sources 26A and 26B emit a mixture of colors similar to the incandescent light in the shown embodiment, a remarkable difference in hue is produced between the translucent indication portions 34A and 34B and the surrounding areas. In this respect, too, the passenger can easily notice the mode change.

As seen from the above, in the indication lamp of the present invention that has translucent indication portions, the visibility of the translucent indication portions enhances, and the life of the light source extends.

Particularly in the above embodiment, each one of the light sources 26A and 26B comprises a combination of a single green light emitting diode 30 and two red light emitting diodes 32. Accordingly, it is easily possible to emit a mixture of colors similar to incandescent light by lighting up these diodes simultaneously.

Moreover, the prohibition mark A1 of the translucent indication portion 34A and the arrow mark B1 of the translucent indication portion 34B, to both of which red painting is applied, are constructed as red translucent portions that allow the red light emitted from the red light emitting diodes 32 to pass through. Thus, compared to an arrangement that uses white light emitting diodes, a brighter indication in more vivid red is obtained.

The indication lamp 10 described above is for an aircraft passenger cabin in which a number of indication lamps are mounted in the ceiling, each being disposed for each seat. Thus, even if part of the light sources of the indication lamps is changed from the conventional incandescent lamps to the light sources 26A and 26B of the present invention that comprise a green light emitting diode 30 and two red light emitting diodes 32, the translucent indication portions 34A and 34B of these indication lamps can be prevented from being seen in a color remarkably different from other indication lamps.

The light sources 26A and 26B are easily replaced for each of the light source units 18A and 18B by simply removing and reinstalling the screws 28.

In the above embodiment, a single green light emitting diode 30 and two red light emitting diodes 32 are employed so as to light up and emit a mixture of colors of light that is similar to the incandescent light Io. It is nonetheless possible to obtain a color that is similar to the incandescent light Io by way of using a plurality of other light emitting diodes.

As seen from FIG. 4, the color close to the incandescent light Io that is used in the present invention includes not only the colors inside the mixture region M but also any color falling within the first approximation region S1 ($0.37 \leqq x \leqq 0.60$ and $0.34 \leqq y \leqq 0.50$) that also encompasses the mixture region M. Such a color should be able to bring forth illumination of the translucent indication portions 34A and 34B with a soft light of a warm color, such as that emitted by incandescent lamps. Even more preferable is to use a color that falls within the second approximation region S2 ($0.42 \leqq x \leqq 0.57$ and $0.38 \leqq y \leqq 0.46$), which is narrower than the first approximation region S1, from a standpoint of obtaining a color that is even closer to the color I emitted by the incandescent lamp employed in the conventional indication lamp.

A modified example of the above embodiment will be described next with reference to FIGS. 5A, 5B, 6A and 6B.

The modified example is the same in structure as the above-described embodiment. The modified example is also the same as the above embodiment in that ON/OFF control is provided for each of the light source units 18A and 18B. The difference is the manner of the light-up mode.

In the modified example, when it becomes necessary to prohibit smoking, two light sources 26A of the light source unit 18A are lit simultaneously in a simultaneous light-up mode; and when it is not necessary to prohibit smoking, the light sources 26A are lit in a green light-up mode. When it becomes necessary to have passengers fasten their seat belts, three light sources 26B of the light source unit 18B are lit simultaneously in the simultaneous light-up mode; and when it is unnecessary for passengers to fasten their seat belts, then they are lit in the green light-up mode.

In the above simultaneous light-up mode, both the green light emitting diode 30 and the red light emitting diodes 32 of each one of the light sources 26A and 26B are lit so as to emit a mixture of colors of the light similar to the incandescent light. In the above green light-up mode, only the green light emitting diode 30 is lit so as to emit a green light.

Figure 6A:
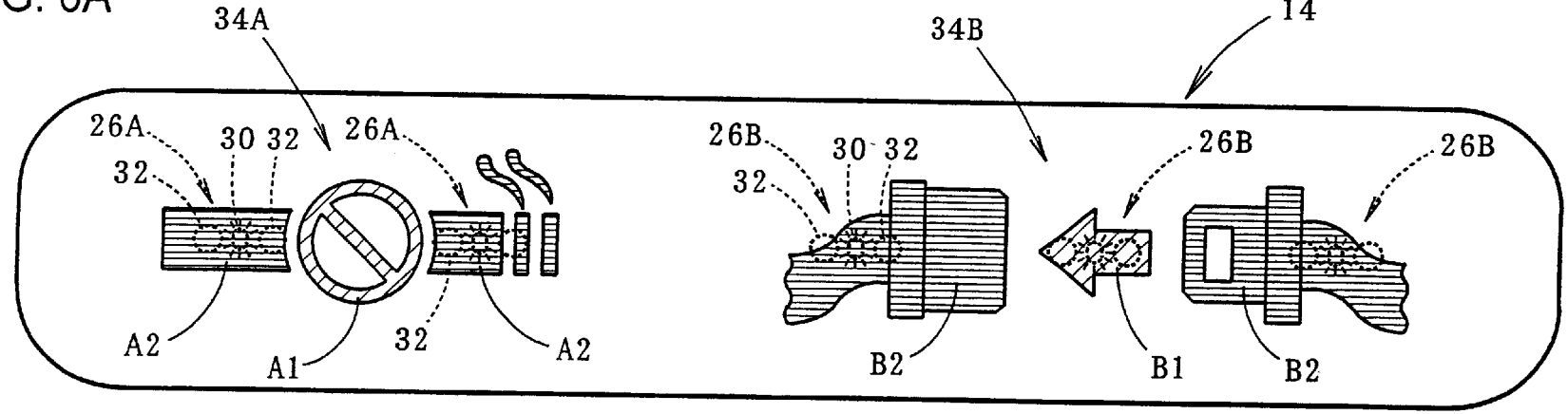
FIGS. 6A and 6B are front views of the front cover showing another operation of the embodiment of the present invention.

In the green light-up mode, as seen from FIG. 6A, only the green light emitting diodes 30 of the light sources 26A and 26B are lit. At this time, the translucent indication portions 34A and 34B are illuminated with a green light from behind, which makes the cigarette mark portions A2 of the translucent indication portion 34A and the seat belt mark portions B2 of the translucent indication portion 34B look brightly in green. On the other hand, the prohibition mark A1 of the translucent indication portion 34A and the arrow mark B1 of the translucent indication portion 34B look dimly, since the green light illuminated from behind does not pass through these portions, to which red printing is applied.

Figure 6B:
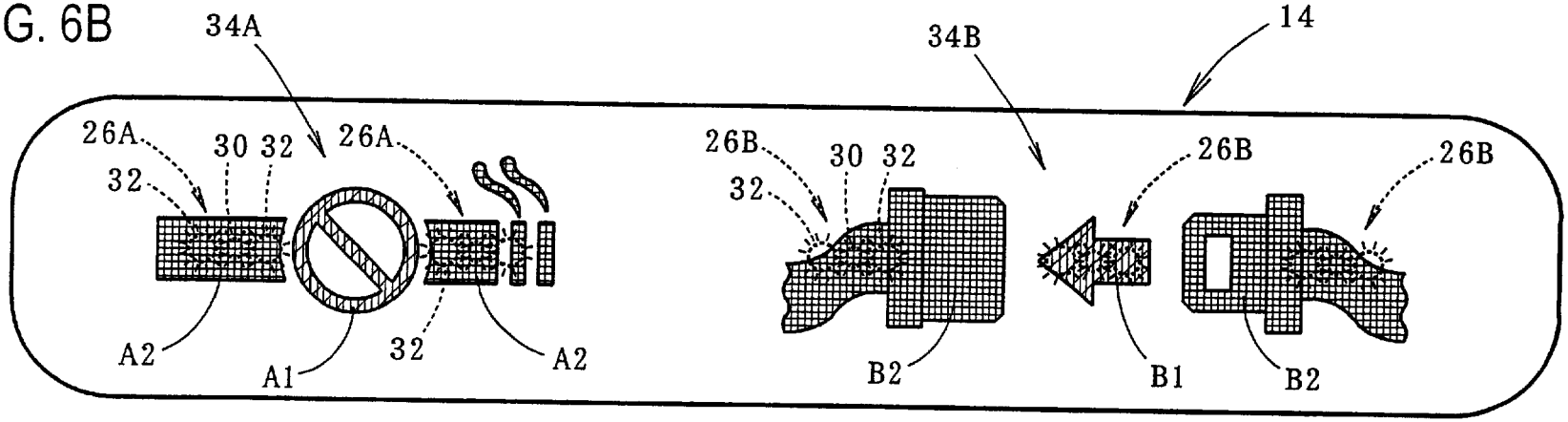
Figure 7:
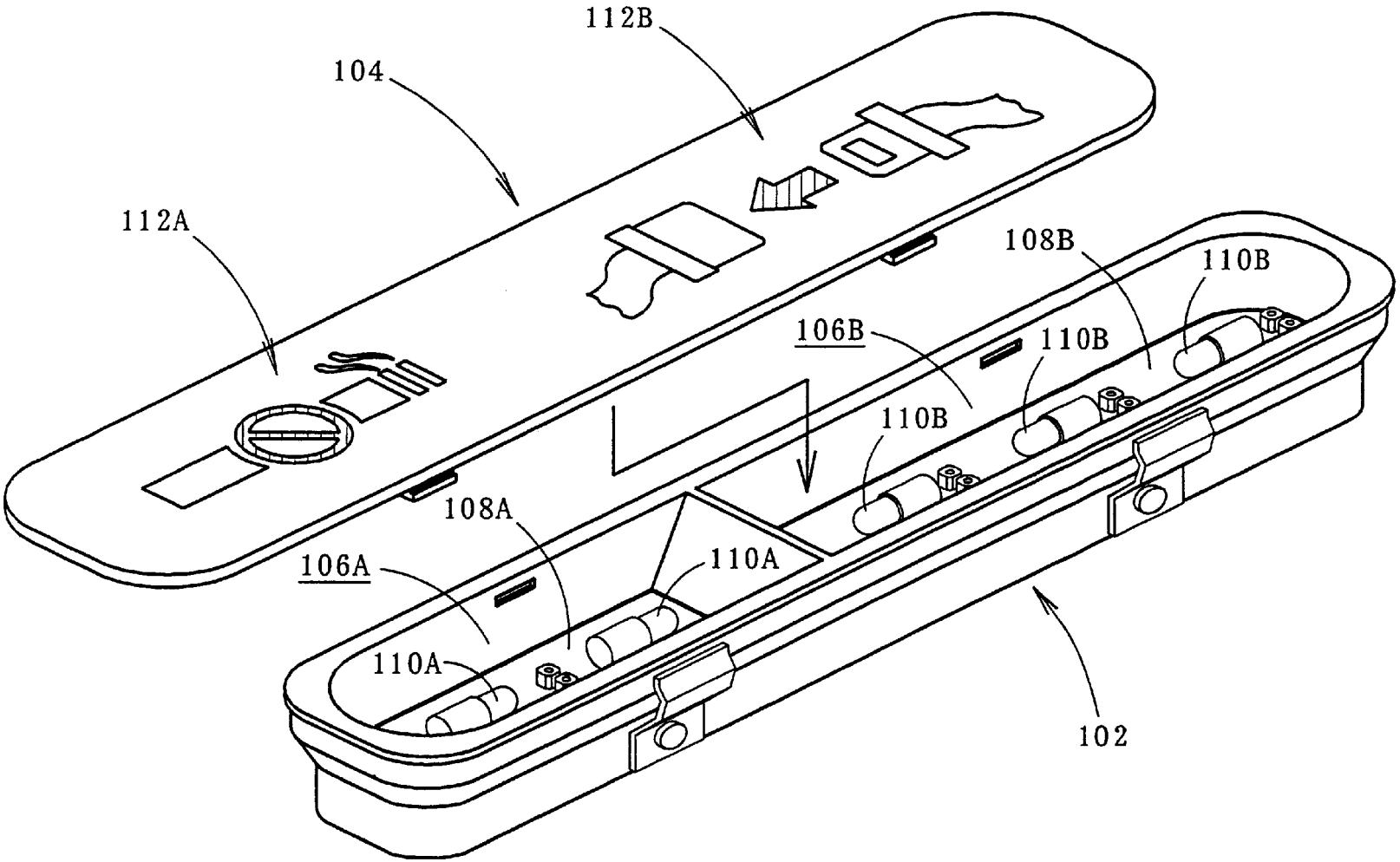
FIG. 7 is an exploded perspective view of the conventional indication lamp.

On the other hand, in the simultaneous light-up mode, as seen from FIG. 6B, both the green light emitting diode 30 and the red light emitting diodes 32 of the light sources 26A and 26B are lit. As a result, the translucent indication portions 34A and 34B are illuminated with a light that is close to the incandescent light from behind, and the cigarette mark portions A2 of the translucent indication portion 34A and the seat belt mark portions B2 of the translucent indication portion 34B look brightly in a color similar to the incandescent light. In the meantime, the prohibition mark A1 of the translucent indication portion 34A and the arrow mark B1 of the translucent indication portion 34B look brightly in vivid red, since the red light emitted by the red light emitting diodes 32 illuminates from behind and passes through the red printing surface.

Thus, according to the modified example, the indication lamp in the simultaneous light-up mode is seen in the same manner as in the above-described embodiment; and in addition, in the green light-up mode, the red translucent portions (the prohibition mark A1 and the arrow mark B1) are kept dim while the remaining portions (the cigarette mark portions A2 and the seat belt mark portions B2) illuminate in green. Accordingly, passengers can easily aware that the light-up mode has been changed.

In the modified example, when it is not necessary to have passengers refrain from smoking and fasten their seat belts, the cigarette mark portions A2 of the translucent indication portion 34A and the seat belt mark portions B2 of the translucent indication portion 34B look brightly in the green light-up mode.

If it is attempted to obtain the same lighting manner as above with an incandescent lamp or a white light emitting diode, there are some problems.

Generally, the light emitted by incandescent lamps and white light emitting diodes contains red wavelength components. When they are lit to illuminate the cigarette mark portions A2 and the seat belt mark portions B2, the prohibition mark A1 and the arrow mark B1 look brightly in red, though there is no need for prohibiting smoking or urging fastening of seat belts. As a result, it becomes necessary to provide a partition wall between the prohibition mark A1 and the cigarette mark portions A2 in the lamp chamber 16A, and between the arrow mark B1 and the seat belt mark portions B2 in the lamp chamber B2 in the lamp chamber 16B. When the shape of graphic representations on the translucent indication portions 34A and 34B is complicated, it becomes difficult to solve the problem by merely forming partition walls.

In the modified example described above, no such partition walls are required, and it is assured that the cigarette mark portions A2 and the seat belt mark portions B2 can look brightly, while making the prohibition mark A1 and the arrow mark B1 look dimly. Moreover, it is possible to provide complicated shapes of graphic representations on the translucent indication portions 34A and 34B.

In the above embodiments, the indication lamp has a non-smoking sign and a seat belt fastening sign. The present invention is applicable to many different kinds of indication lamps used in aircraft passenger cabins, such as a vacancy/occupied sign on a toilet door. The present invention is also applicable to indication lamps used for various other purposes not in aircraft passenger cabins.

What is claimed is:

1. An indication lamp comprising a light source, a housing and a front cover, wherein said light source is comprised of a plurality of light emitting diodes having different colors of illumination, thus illuminating a mixture of colors that is similar to a light emitted by an incandescent lamp, said cover is provided with an indication portion that includes a translucent portion which is partially colored with a predetermined color, said light source is provided in said housing so as to positionally correspond to said indication portion, and at least one light emitting diode that forms said light source has a light color that is similar to said predetermined color of said translucent portion of said indication portion, thus, when lit, displaying said translucent portion of said predetermined color.

2. The indication lamp according to claim 1, wherein said cover is provided with a plurality of indication portions, and said housing is provided with a partition wall that prevents a light from said light source of one indication portion that is under illumination from being directed to another indication portion that is no under illumination.

3. The indication lamp according to claim 1 or 2, wherein said light source is comprised of red light emitting diodes and green light emitting diodes, and said translucent indication portion of said predetermined color is colored in red.

4. An indication lamp comprising:

a housing with an inside thereof divided into a plurality of sections;

a light source installed inside each of said sections, said light source comprising a plurality of light emitting diodes emitting different colors so as to illuminate a mixture of colors that is substantially the same as a color of an incandescent lamp light; and a front cover covering said two sections of said housing, said front cover being formed with a plurality of translucent indication portions of predetermined shapes that allow a part of light from said light source to pass through, each of said translucent indication portions positionally corresponding to said light source.

5. The indication lamp according to claim 4, wherein said plurality of light emitting diodes comprise red light emitting diodes that emit a red light and green light emitting diodes that emit a green light.

6. The indication lamp according to claim 5, wherein said red light emitting diodes and said green light emitting diodes are lit simultaneously so as to provide said mixture of colors.

* * * * *